US008758527B2

(12) United States Patent
Mukherji et al.

(10) Patent No.: US 8,758,527 B2
(45) Date of Patent: Jun. 24, 2014

(54) GEAR MATERIAL FOR AN ENHANCED ROTORCRAFT DRIVE SYSTEM

(75) Inventors: Tapas K. Mukherji, Shelton, CT (US); Michael E. Dandorph, Shelton, CT (US); Bruce D. Hansen, Shelton, CT (US); Edward J. Karedes, Cheshire, CT (US)

(73) Assignee: Sikorsky Aircraft Corporation, Stratford, CT (US)

( * ) Notice: Subject to any disclaimer, the term of this patent is extended or adjusted under 35 U.S.C. 154(b) by 801 days.

(21) Appl. No.: 11/611,173

(22) Filed: Dec. 15, 2006

(65) Prior Publication Data

US 2008/0145690 A1 Jun. 19, 2008

(51) Int. Cl.

| | |
|---|---|
| ***C23C 8/00*** | (2006.01) |
| ***C23C 8/22*** | (2006.01) |
| ***C21D 9/32*** | (2006.01) |

(52) U.S. Cl.
USPC ..... 148/225; 148/218; 148/319; 148/586

(58) Field of Classification Search
USPC ..... 148/95, 218, 225, 586, 319; 428/610
See application file for complete search history.

(56) References Cited

U.S. PATENT DOCUMENTS

| | | | | |
|---|---|---|---|---|
| 5,087,415 | A | 2/1992 | Hemphill et al. | |
| 5,268,044 | A | 12/1993 | Hemphill | |
| 5,536,335 | A * | 7/1996 | Burris | 148/233 |
| 5,893,423 | A | 4/1999 | Selfors et al. | |
| 6,220,105 | B1 | 4/2001 | Cripe | |
| 2004/0250921 | A1 * | 12/2004 | Yamaguchi | 148/218 |

OTHER PUBLICATIONS

Lampman, S., "Introduction to Surface Hardening of Steels-Diffusion Methods of Surface Hardening", ASM Handbook, vol. 4, 1991, p. 3-4.*

"Enhanced Microhardness of Four Modern Steels Following Nitrogen Ion Implantation", Surface and Coatings Technology 138 (2001) 220-228, Nov. 10, 2000.

Li, Manyuan et al., Enhanced Microhardness of Four Modern Steels Following Nitrogen Ion Implantation. Surface and Coating Technology. Apr. 2001, vol. 138, pp. 220-228.

* cited by examiner

*Primary Examiner* — Roy King
*Assistant Examiner* — Caitlin Kiechle
(74) *Attorney, Agent, or Firm* — Carlson, Gaskey & Olds, P.C.

(57) ABSTRACT

A surface processing method includes the step of increasing a surface hardness of a metal having a nominal composition that includes about 0.21-0.25 wt % carbon, about 2.9-3.3 wt % chromium, about 11-12 wt % nickel, about 13-14 wt % cobalt, about 1.1-1.3 wt % molybdenum, and a balance of iron from a first hardness to a second hardness. For example, the method is used to produce a surface-hardened component that includes a core section having a first hardness between about 51 $HR_C$ and 55 $HR_C$ and a case section having a second hardness that is greater than the first hardness.

11 Claims, 1 Drawing Sheet

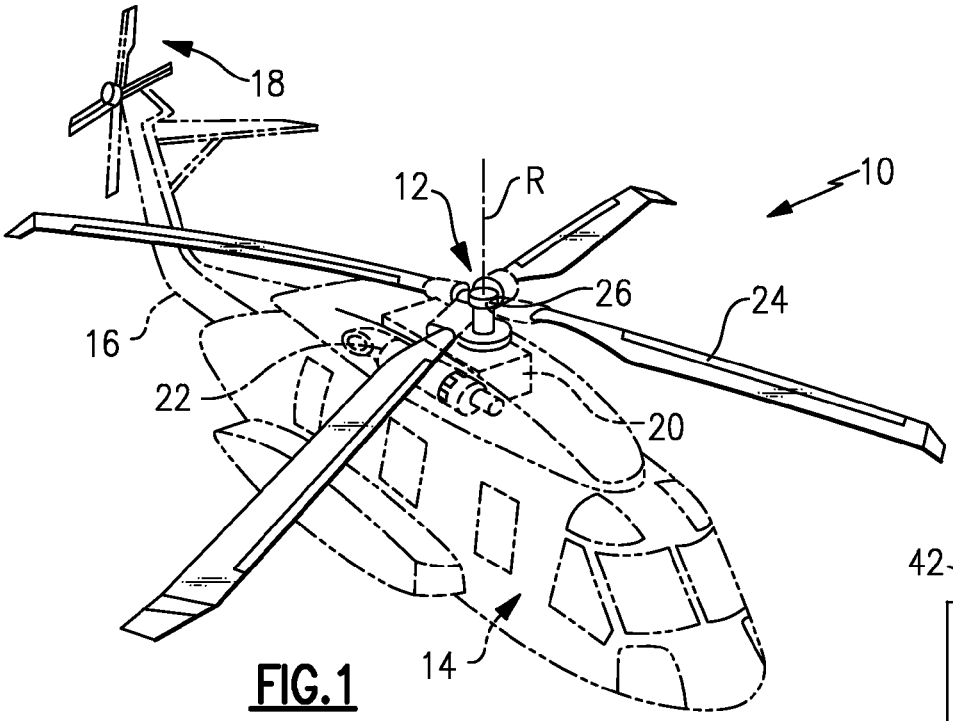
FIG.1
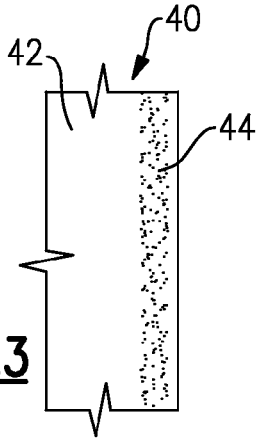
FIG.3
FIG.2
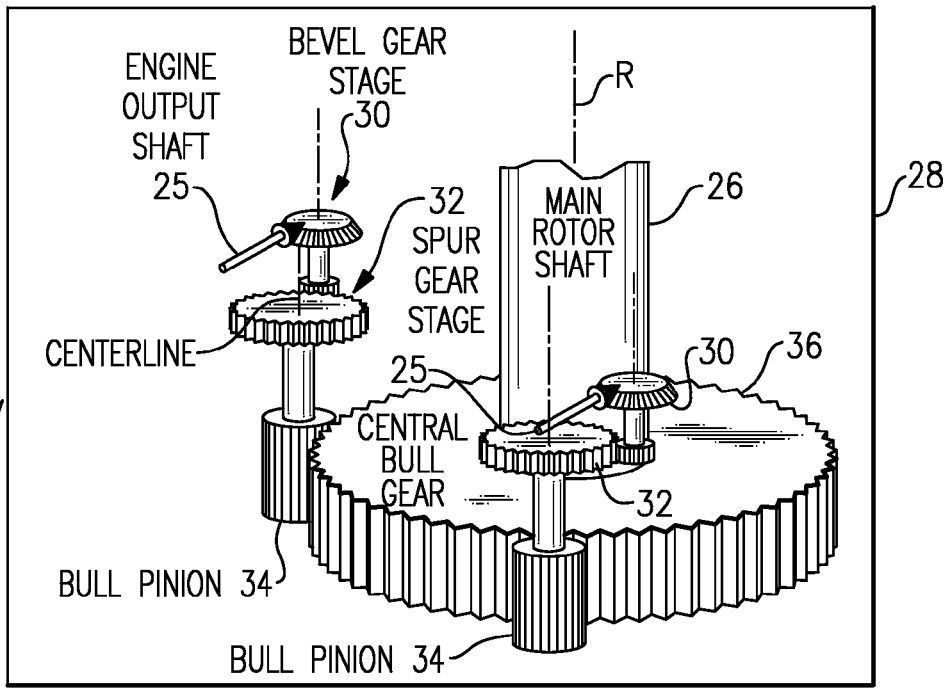

GEAR MATERIAL FOR AN ENHANCED ROTORCRAFT DRIVE SYSTEM

BACKGROUND OF THE INVENTION

The present invention relates to hardening metals or metal alloys, and more particularly to hardening AerMet® 100 alloy for uses such as gears within a rotary-wing aircraft gearbox.

Certain compositions of steel, such as Pyrowear® 53 and 9310, have been used for gears or other applications requiring high strength and fatigue resistance. Pyrowear® 53 and 9310 typically have a strength of 180-200 ksi and a hardness of 30-45 $HR_c$. To increase fatigue resistance, the gears are carburized to produce a case that surrounds a less hard core. For example, gears made of Pyrowear® 53 or 9310 are heated to an austenizing temperature of 1650° F. in a 0.8% carbon atmosphere. The carbon diffuses into solid austenite solution. Upon quenching, the austenite forms high carbon martensite having a surface carbon level around 0.8% to 1.0%, which hardens the surface.

Although Pyrowear® 53 and 9310 are useful for gears and other applications, there is a need for even stronger and more fatigue-resistant gears. AerMet® 100 is an alloy developed by Carpenter Technology based on the composition of US Air Force Alloy 1410. When processed per CarTech specified directions or per AMS 6532 specification, AerMet® 100 develops an ultimate strength of 280 ksi, a fracture toughness value of 115 ksi·inch$^{1/2}$ and a hardness of 53 $HR_C$. The strength and toughness combination make AerMet® 100 attractive for use in gears, however, AerMet® 100 lacks the desired surface hardness.

One proposed solution to enable use of AerMet® 100 in gears is to carburize the AerMet® 100 using the conventional carburization process that is used for Pyrowear® 53 and 9310. However, instead of forming hardened high carbon martensite, AerMet® 100 forms undesirable microstructures that prevent use of AerMet® 100 in gears and other applications.

Accordingly, it is desirable to provide a method of hardening AerMet® 100 for use in gears and other applications, while avoiding the shortcomings and drawbacks of the prior art.

SUMMARY OF THE INVENTION

A surface processing method includes the step of increasing a surface hardness of a metal having a composition that includes about 0.21-0.25 wt % carbon, about 2.9-3.3 wt % chromium, about 11-12 wt % nickel, about 13-14 wt % cobalt, about 1.1-1.3 wt % molybdenum, and a balance of iron from a first hardness to a second hardness.

In one example, the method is used to produce a surface-hardened component that includes a core section having a first hardness between about 51 $HR_C$ and 55 $HR_C$ and a case section having a second hardness that is greater than the first hardness. In one example, the surface-hardened component is a gear for a main gearbox of a rotary-wing aircraft. Optionally, the gear is made of the metal having the composition that includes about 0.21-0.25 wt % carbon, about 2.9-3.3 wt % chromium, about 11-12 wt % nickel, about 13-14 wt % cobalt, about 1.1-1.3 wt % molybdenum, and a balance of iron, but is not surface hardened, depending on the needs of the particular application.

The disclosed examples thereby provide a gear made of AerMet® 100 and a method of hardening AerMet® 100 for use in gears and other applications.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows:

FIG. 1 is a schematic view of an example rotary-wing aircraft having a main gearbox.

FIG. 2 is a schematic view of an example main gearbox having gears made of AerMet® 100.

FIG. 3 is a schematic view of a portion of a case hardened gear made of AerMet® 100.

DETAILED DESCRIPTION OF THE PREFERRED EMBODIMENT

FIG. 1 schematically illustrates an example rotary-wing aircraft 10 having a main rotor system 12. In this example, the aircraft 10 includes an airframe 14 having an extending tail 16 which mounts a tail rotor system 18, such as an anti-torque system. The main rotor assembly 12 is driven about an axis of rotation R through a main gearbox (illustrated schematically at 20) by one or more engines 22. The main rotor system 12 includes a multiple of rotor blades 24 mounted to a rotor hub 26. Although a particular helicopter configuration is illustrated and described in the disclosed example, other configurations and/or machines, such as high speed compound rotary wing aircraft with supplemental translational thrust systems, dual contra-rotating, coaxial rotor system aircraft, turboprops, tilt-rotors and tilt-wing aircraft, will also benefit.

The main gearbox 20 is mechanically connected to the main rotor system 12 and to the tail rotor system 18 so that the main rotor system 12 and the tail rotor system 18 are both driven by the main gearbox 20 but the main rotor system 12 may be driven at variable speeds relative the tail rotor system 18. The main gearbox 20 is preferably interposed between the one or more gas turbine engines 22, the main rotor system 12 and the tail rotor system 18. The main gearbox 20 carries torque from the engines 22 through a multitude of drive train paths.

FIG. 2 illustrates selected portions of one example of the main gearbox 20, which transmits torque from respective engine output shafts 25 of the engines 22 to a main rotor shaft 26 of the main rotor assembly 12. The main gearbox 20 is mounted within a housing 28 which supports the geartrain therein as well as the main rotor shaft 26. Each engine output shaft 25 transmits torque through a bevel gear 30 and a spur gear 32 to a bull pinion gear 34. The bull pinion gears 34 are mounted for rotation within the housing 28 and intermesh with a central bull gear 36, which is coupled for rotation with the main rotor shaft 26. The illustrated example relates to a helicopter gearbox having highly-loaded torque transmitting gears, however, it will be appreciated that the disclosed examples are applicable to other types of gears, other components in the aircraft 10, and components for other types of applications.

One or more of the bevel gears 30, the spur gears 32, the bull pinion gears 34, and the central bull gear 36 (hereafter the gear or gears) are fabricated from AerMet® 100. AerMet® 100 has a nominal composition of about 0.21-0.25 wt % carbon, about 2.9-3.3 wt % chromium, about 11-12 wt % nickel, about 13-14 wt % cobalt, about 1.1-1.3 wt % molybdenum, and a balance of iron. The composition may additionally include about 0.1 wt % manganese, about 0.1 wt % silicon, about 0.008 wt % phosphorous, about 0.005 wt % sulfur, about 0.015 wt % titanium, about 0.015 wt % aluminum, and trace amounts of oxygen and nitrogen. Compared to previously known alloys, AerMet® 100 provides the benefit of higher strength and toughness that permits greater amounts of torque to be transferred, which in turn enables an increase in horsepower-to-weight ratio. The term "about" as used in this description relative to percentages or compositions refers to possible variation in the compositional percentages, such as normally accepted variations or tolerances in the art.

FIG. 3 illustrates a portion 40 of one of the gears. In this example, the AerMet® 100 of the gear is case hardened to increase the fatigue resistance (i.e., contact fatigue strength) of the gear. The portion 40 includes a core section 42 and a hardened case section 44 at the surface. It is to be understood that case hardening AerMet® 100 gears is desired for selected gears, but may not be desired for other gears or other uses, depending on the expected mechanical requirements.

The core section 42 has a hardness equivalent to the initial hardness of AerMet® 100, which is 51-55 $HR_C$ when processed per CarTech specified directions or per AMS 6532 specification. The hardness of the case section 44 is 58-62 $HR_C$. Preferably, the hardness of the core section 42 is 53 $HR_C$, and the hardness of the case section 44 is about 58.5-60 $HR_C$. The hardness of 58-62 $HR_C$ of the case section 44 provides the gears with a level of fatigue resistance that is desirable for use in the main gearbox 20.

The hardness of 58-62 $HR_C$ of the case section 44 is obtained by increasing the carbon concentration using a carburization process in a plasma furnace or other suitable equipment. The selected carbon concentration corresponds to the desired hardness of the case section 44. The initial carbon concentration of the AerMet® 100 of the gear is about 0.21-0.25 wt % carbon as described above, and the carburization process increases the carbon concentration to about 0.5-0.65 wt % carbon to achieve the hardness of 58-62 $HR_C$. Preferably, the carburization process increases the carbon concentration to about 0.63-0.65 wt % carbon to achieve the hardness of 58.5-60 $HR_C$.

A first example carburization process for obtaining the carbon concentration of about 0.5-0.65 wt % carbon includes heating the gear for a preselected amount of time at a preselected set temperature in an atmosphere having a preselected carbon potential (i.e., carbon concentration). One or more boost cycles may be used to expose the gear to an atmosphere having a carbon potential between about 1.1% and 2.0% at a first set temperature of 1700-1900° F. for two minutes to increase a surface carbon concentration. The time may be varied from one minute to twenty minutes, depending on the desired surface carbon concentration. Each boost cycle is followed by a diffusion cycle in an atmosphere having little or no carbon potential at a second set temperature of about 1700-1900° F. The diffusion cycles allow carbon near the surface of the gear to diffuse into the gear, which allows additional carbon to be absorbed at the surface in subsequent boost cycles. The diffusion cycles vary in time, depending on the desired thickness of the hardened case section 44.

A second example carburization process includes three sets of alternating boost and diffusion cycles at 1900° F. are used with a carbon potential of about 1.8% to obtain the carbon concentration of about 0.5-0.65 wt % at the surface and a carbon concentration of about 0.4-0.45 wt % carbon at a depth of 0.04 inches. The first set includes a boost cycle of two minutes followed by a diffusion cycle of fifteen minutes, the second set includes a boost cycle of two minutes followed by a diffusion cycle of fifteen minutes, and the third set includes a boost cycle of two minutes followed by a diffusion cycle of seventy-five minutes.

It is to be understood that the preselected parameters (temperature, time, and carbon potential) may be varied from the disclosed parameters, depending on the desired case hardness, surface carbon concentration, and case depth. The above example parameters or other useful parameters for case hardening AerMet® 100 gears without producing undesirable microstructures or retained austenite can be found experimentally using varied carbon potentials, temperatures, and times. For example, although the temperature dependence of the maximum solubility (i.e., concentration) of carbon can be determined by experiment, its concentration can be controlled by using the diffusivity of carbon, in the austenite phase of AerMet® 100. At a particular carbon potential the carbon content of the steel in the case is determined using the equation $D=D_o \exp(-Q/RT)$, where D is the diffusivity, $D_o$ is a constant for the given diffusion system, Q is an activation energy, R is the Universal gas constant, and T is an experimental temperature and the time at temperature. Thus, by determining the diffusivity experimentally, one can choose parameters to obtain hardening while avoiding exceeding the maximum solubility of carbon in the austenite phase of AerMet® 100, which would otherwise result in undesirable microstructures at grain boundaries of the AerMet® 100 or retained austenite phases from carbon that does not dissolve into the austenite.

Choosing parameters that avoid exceeding the maximum solubility of carbon in the austenite phase permit hardening of the AerMet 100 through precipitation of dispersed carbides. If the maximum solubility at a temperature is exceeded, a portion of the carbon does not dissolve into the austenite and instead forms relatively large undesirable microstructures (e.g., carbides formed at grain boundaries) and retained austenite upon quenching. However, if the carbon concentration is maintained below the maximum solubility, as taught above, the dissolved carbon precipitates from the low carbon martensite upon quenching of the austenite to form a uniform dispersion of relatively small metal carbide phases (e.g., $M_2C$) within the grains rather than forming other large carbides at the grain boundaries. The fine distribution and relatively small size and the location of these carbides (compared to the alternative of relatively large undesirable microstructures if the maximum solubility is exceeded) produce the desired increase in hardness of the case section 44.

Optionally, a nitriding process further increases the hardness of the case section 44 by increasing the surface concentration of nitrogen. Nitriding can be used to produce a hardness of the case section 44 of about 64-70 $HR_C$.

A nitriding process for obtaining an increase in nitrogen surface concentration includes heating the gear for a preselected amount of time at a preselected set temperature in an atmosphere having a preselected nitrogen potential (i.e., nitrogen concentration). One or more boost cycles may be used to expose the gear to an atmosphere having a nitrogen potential of about 0.25 to 3% at a temperature between 850° F.-950° F. for one to fifteen minutes. The boost cycles are followed by diffusion cycles at a temperature between 850° F.-950° F. for a time between four and seventy-five hours. The nitriding process produces a nitrided case depth of about 0.008 to 0.010 inches. As described above for the carburization process, parameters other than those taught above can be selected through experimentation and determination of the diffusivity to obtain a desired increase in hardness. Likewise, determination of the diffusivity permits selection of parameters that avoid exceeding the maximum solubility of nitrogen in the ferritic phase of AerMet® 100, which would otherwise result in undesirable microstructures at the grain boundaries from nitrogen exceeding its solubility limit in ferrite at the nitriding temperature. Also, determination of the diffusivity permits selection of parameters that avoid displacing carbon from the carburization process out of the grains into the grain boundaries as relatively large carbides.

Thus, the disclosed embodiments illustrate methods for hardening gears or other components that are fabricated from AerMet 100. Previously, hardening AerMet 100 was technologically unfeasible because conventional processing results in undesirable microstructures (e.g., carbides at the grain boundaries and also retained austenite in side the grain) that weaken the gears and thereby prevent use in high stress and high fatigue environments. As the disclosed embodiments illustrate, the composition of AerMet 100 hardens by a different mechanism (i.e., precipitation) than previously used steels, which harden by formation of high carbon martensite upon quenching. Therefore, the embodiments herein teach processes for hardening AerMet 100 without forming deleterious microstructures that would otherwise prevent or limit use of AerMet 100 for gears.

Although a combination of features is shown in the illustrated embodiments, not all of them need to be combined to realize the benefits of various embodiments. In other words, a system designed according to one embodiment will not necessarily include all of the features shown in any one of the Figures or all of the portions schematically shown in the Figures. Moreover, selected features of one embodiment may be combined with selected features of other embodiments.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A surface hardening method comprising the step of:

determining a diffusivity of a metal using an equation, $D=D_o \exp(-Q/RT)$, where D is the diffusivity, $D_o$ is a diffusion constant for the metal, Q is an activation energy, R is the Universal gas constant, T is the selected temperature, the metal having a composition that includes about 0.21-0.25 wt % carbon, about 2.9-3.3 wt % chromium, about 11-12 wt % nickel, about 13-14 wt % cobalt, about 1.1-1.3 wt % molybdenum, and a balance of iron;

carburizing the metal at a selected temperature for a selected amount of time in a carbonaceous atmosphere, including controlling the temperature, time and carbon potential of the carbonaceous atmosphere during carburization with respect to the diffusivity of the carbon in the metal such that the carbon dissolved into the metal from the carbonaceous atmosphere during the carburization does not exceed a solubility limit of the carbon in the metal, the carburizing increasing a surface carbon concentration of the metal from the 0.21-0.25 wt % carbon to about 0.5-0.65 wt % carbon; and quenching and aging to precipitate a distribution of carbides within grains of the metal, thus increasing an initial surface hardness of about 51-55 $HR_C$ of the metal to a second hardness of about 58-62 $HR_C$.

2. The method as recited in claim 1, further including increasing a surface nitrogen concentration of the metal to further increase the surface hardness.

3. The method as recited in claim 1, further including increasing a surface carbon concentration of the metal from the 0.21-0.25 wt % carbon to about 0.63-0.65 wt % carbon.

4. The method as recited in claim 1, further including increasing the surface hardness of the metal wherein the composition additionally includes about 0.1 wt % manganese, about 0.1 wt % silicon, about 0.008 wt % phosphorous, about 0.005 wt % sulfur, about 0.015 wt % titanium, about 0.015 wt % aluminum, and trace amounts of oxygen and nitrogen.

5. The method as recited in claim 1, wherein the controlling of the carburization includes increasing a carbon concentration at a surface of the metal to a concentration that is lower than the solubility limit followed by diffusing carbon from the surface toward a core of the metal, thereby reducing the carbon concentration at the surface such that the surface can take on additional carbon without exceeding the solubility limit, followed by another cycle of increasing the carbon concentration at the surface.

6. The method as recited in claim 1, wherein the carburizing includes conducting a boost cycle within a high carbon potential atmosphere that increases carbon concentration of a surface of the metal followed by conducting a diffusion cycle in a lower carbon potential atmosphere that diffuses the carbon from the surface towards a core of the metal, thereby reducing the carbon concentration at the surface.

7. The method as recited in claim 1, wherein the carburizing includes conducting a boost cycle within a high carbon potential atmosphere that increases carbon concentration of a surface of the metal followed by conducting a diffusion cycle in a lower carbon potential atmosphere that diffuses the carbon from the surface towards a core of the metal, thereby reducing the carbon concentration at the surface such that the surface can take on additional carbon, followed by another boost cycle to introduce more carbon into the surface.

8. The method as recited in claim 1, wherein the controlling of the carburization includes avoiding formation of carbides at the grain boundaries in the metal during the carburization.

9. The method as recited in claim 1, wherein the carbonaceous atmosphere has a carbon potential of 4.4-9.5 times greater than the amount of carbon in the composition of the metal.

10. The method as recited in claim 1, wherein the controlling of the carburization includes avoiding formation of retained austenite in the metal and avoiding formation of carbides at the grain boundaries in the metal.

11. The method as recited in claim 1, wherein the diffusivity of the carbon in the metal is diffusivity of the carbon in an austenite phase of the metal.

* * * * *